US008333563B2

(12) United States Patent
Razzell

(10) Patent No.: US 8,333,563 B2
(45) Date of Patent: Dec. 18, 2012

(54) BLADE ARRANGEMENT

(75) Inventor: Anthony G. Razzell, Derby (GB)

(73) Assignee: Rolls-Royce PLC, London (GB)

( * ) Notice: Subject to any disclaimer, the term of this patent is extended or adjusted under 35 U.S.C. 154(b) by 659 days.

(21) Appl. No.: 12/457,785

(22) Filed: Jun. 22, 2009

(65) Prior Publication Data

US 2010/0054917 A1 Mar. 4, 2010

(30) Foreign Application Priority Data

Aug. 29, 2008 (GB) ..... 0815666.3

(51) Int. Cl.
*F01D 5/32* (2006.01)

(52) U.S. Cl. ..... 416/193 A; 416/220 R

(58) Field of Classification Search ..... 416/193 R, 416/193 A, 220 R
See application file for complete search history.

(56) References Cited

U.S. PATENT DOCUMENTS

| | | | | |
|---|---|---|---|---|
| 3,834,831 | A | 9/1974 | Mitchell | |
| 4,743,164 | A | 5/1988 | Kalogeros | |
| 5,242,270 | A | 9/1993 | Partington et al. | |
| 5,244,345 | A * | 9/1993 | Curtis | 416/95 |
| 6,354,803 | B1 * | 3/2002 | Grover et al. | 416/190 |
| 6,371,727 | B1 | 4/2002 | Stangeland et al. | |
| 7,931,442 | B1 * | 4/2011 | Liang | 416/193 A |
| 2002/0090296 | A1 | 7/2002 | Kuwabara et al. | |
| 2003/0012654 | A1 | 1/2003 | Strassberger et al. | |
| 2008/0286106 | A1 * | 11/2008 | Keith et al. | 416/193 A |

FOREIGN PATENT DOCUMENTS

| | | |
|---|---|---|
| GB | 1 358 798 | 7/1974 |
| GB | 2 344 383 A | 6/2000 |

* cited by examiner

*Primary Examiner* — Dwayne J White
(74) *Attorney, Agent, or Firm* — Oliff & Berridge, PLC

(57) ABSTRACT

Blade arrangements formed in a blisk configuration include a number of blades secured integrally or through welds or similar bonding to a rotor disc. The blades may be subject to vibration and it would be desirable to provide heat protection to junctions between the blades and the rotor. By providing insert elements between adjacent platform sections of a blade pair, vibrational damping as well as heat shielding and capability with regard to aerodynamic profiling is achieved.

16 Claims, 2 Drawing Sheets

BLADE ARRANGEMENT

BACKGROUND

The present invention relates to blade arrangements and more particularly to blade arrangements of a so-called blisk nature utilised in gas turbine engines.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 30.

In view of the above it will be appreciated that blade assemblies comprise a number of blades secured around generally a rotatable hub or rotor. Traditionally, these blades have been secured through appropriate blade roots possibly of a fir tree nature. Such connections for the blades can add significantly to weight and complexity of formation. In such circumstances more recently alternative blade constructions have been proposed and utilised. In particular with regard to compressor stages and with respect to small turbines it is possible to create a blisk format. In such circumstances generally a disc of material is utilised to act as a rotor upon which blades are secured through an appropriate welding technique. The blades are either cast with the disc as one piece or as indicated bonded by an appropriate friction welding or similar joining process. In such circumstances the blades are simply secured by an appropriate integral or bonded weld joint to the disc without the necessity for blade roots etc to secure the blades to the rotor. Thus, the number of machining and other processes is reduced as well as the weight of the assembly.

When designing a blade arrangement it is important to consider vibration, to protect the disc and in particular the joint between the blade and the disc from excessive heating and also to define an appropriate aerodynamic profile for operational purposes. With regard to vibration previous arrangements typically have not considered vibration as an issue as the resonant frequency can be designed out of the running range of the blade. Protection of a disc rim from annulus gas is also an issue as indicated but generally the disc material is capable of taking the annulus gas temperature as it is formed from the same material as the blade. Furthermore, it is possible to profile end walls in order to improve aerodynamic performance but not without difficulty. Previous arrangements have limited design options.

SUMMARY

In accordance with aspects of the present invention there is a provided a blade arrangement for a gas turbine, the arrangement comprising a plurality of blades secured to a rotor, adjacent blades forming a blade pair having platform sections displaced from a junction between each blade and the rotor, the arrangement having an insert element extending between ends of the platform sections for positional control of the blades in use.

Generally, the positional control relates to vibration and particularly vibration damping. Possibly, the positional control relates to providing a protective barrier to the junction and/or rotor. Generally, the protective barrier is with respect to inhibiting ingress of hot gas in use to the junction and/or the rotor. Possibly, the positional control relates to defining an aerodynamic profile for the arrangement about the rotor.

Generally, the insert element interlocks with an edge of each platform in a blade pair. Possibly, the edge incorporates a slot or ridge to engage a reciprocal part of the insert element. Possibly, the arrangement incorporates a lock plate to secure the insert element. Possibly, the lock plate acts on one side of a blade pair in use.

Possibly, the platform section and the insert element are displaced from the rotor in order to provide a desired level of positional control.

Possibly, the insert element is secured from above or below adjacent platform sections in a blade pair.

Preferably, the insert element is presented for slide association between the platform sections. Possibly, the insert section comprises a band of material having respective spaced edges for association with the platform sections. Possibly, the spaced edges have a radii about a common centre. Possibly, the insert element has a surface profile.

Also in accordance with aspects of the present invention there is provided a gas turbine engine incorporating a blade arrangement as described above.

BRIEF DESCRIPTION OF THE DRAWINGS

Embodiments of aspects of the present invention will now be described by way example and reference to the accompanying drawings in which.

DETAILED DESCRIPTION OF EMBODIMENTS

Figure 1:
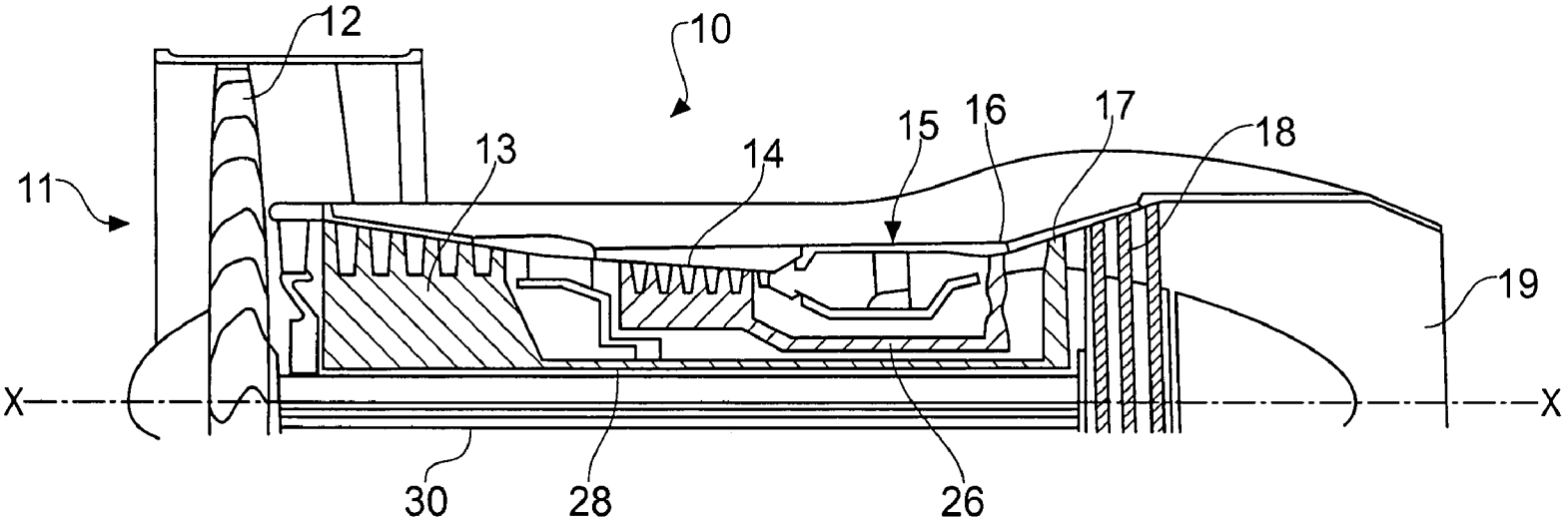
FIG. 1 is a schematic sectioned side view of a ducted fan gas turbine engine incorporating a blade arrangement in accordance with aspects of the present invention.

Aspects of the present invention particularly relate to blisk blade assemblies. In a blisk blade assembly a disc of material creates a rotor upon which blades are secured at an appropriate distribution and at angles in order to create necessary thrust functions within an engine. The blades are secured to the disc through an appropriate bond or possibly by integral casting of the blades with the disc during a fabrication stage. In either event, the blades are generally supported and presented about a junction between each blade and the rotor. Generally, the blades have a platform section either side whereby adjacent blade pairs have a gap between them. The platform sections are generally utilised in order to create an aerodynamic profile and provide some protection with regard to the rotor and/or junction in relation to excessive heating as a result of hot gases. It will be appreciated that problems may occur with regard to heating the rim of a disc in terms of causing creep or low cycle fatigue failure for the blade arrangement in use.

Of particular concern with regard to aspects of the present invention is vibration control. It will be appreciated that the blades being essentially cantilevered about the joint with the rotor disc means that the blades may be subject to vibration which can cause stressing about the junction as well as problems with regard to operational performance of the blade arrangement in use due to slight vibrations and movements of the blade particularly towards the tip edges of the blade. This can include failure by high cycle fatigue.

Aspects of the present invention provide an insert element which extends between platform sections in adjacent blades defined as a blade pair for the purposes of description below. The insert elements in unison about the blade arrangement provide a positional control with regard to the blade in use. This positional control particularly relates to vibrational damping in use. Damping may be as a result of the material from which the insert element is made but more normally is as a result of slide frictional contact between a surface of the platform section and the insert element itself. Such relative movement between the insert element and surfaces of the platform will dampen vibration of the blade in use reducing the likelihood of blade failure by high cycle fatigue. Furthermore, it will be understood that the insert element will have a secondary function with regard to closing the gap between the platform sections and therefore will prevent hot annulus gas from passing through the gaps between the platform sections in a blade pair in order to heat the rim of the disc. Thus, by utilisation of insert elements in accordance with aspects of the present invention the potential for creep or low cycle fatigue failure is reduced. It will also be understood that by provision of an insert element improved aerodynamic profiling to the end walls of the platform sections can be achieved so improving operation. Furthermore it will be understood that the insert elements may have a surface profiling to facilitate operational performance in use. This surface profiling may comprise an undulation in an upper surface of the insert element.

Figure 2:
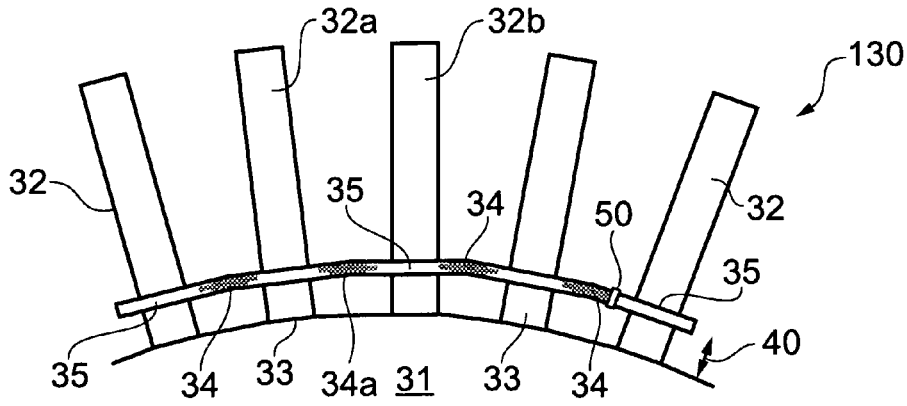
FIG. 2 is a schematic side view of a blade arrangement in accordance with aspects of the present invention.

FIG. 2 provides a schematic front view of a blade arrangement 130 in accordance with aspects of the present invention. Thus, the arrangement 130 comprises a disc 31 and a number of blades 32 secured by joints 33 to the disc 31. Thus, the blade arrangement 130 has a blisk configuration. In accordance with aspects of the present invention insert elements 34 are located between platform sections 35. The insert elements 34 provide a positional control with regard to the blades 32 in order to advantageously provide one or more of the control functions as described above in use. These control functions are vibration damping, heat shielding for the rotor 31 and junction 33 and provision of an improved aerodynamic profile between the platform sections 35.

An insert element 34*a* is secured between blades 32*a*, 32*b*. The insert element 34*a* is secured typically through an interlock created by overlapping slot and ridge elements. Generally, the insert element 34 is slid into position. As described above vibrational damping is achieved through relative sliding and friction contact between the opposed edges of the insert element 34*a* and opposed edge parts of the platforms 35.

Figure 3:
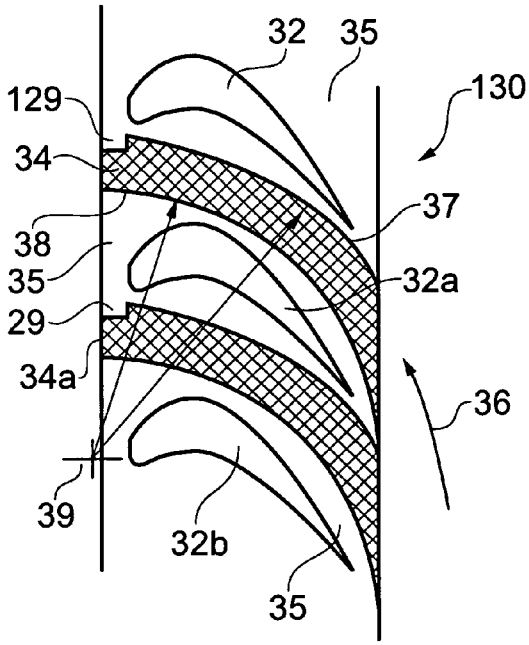
FIG. 3 is a schematic plan view of the blade arrangement depicted in FIG. 2.

FIG. 3 provides a plan view of part of the arrangement 130 as depicted in FIG. 2. Thus, the insert elements 34 are generally slid in the direction of arrowhead 36 in order to achieve location between the platform sections 35. The insert elements 34 are shown in cross hatch in order to distinguish them from the platforms 35. In use the insert elements 34 may be formed from a material which creates an appropriate vibrational damping effect but alternatively could be formed from similar materials to which the platforms 35 are formed. The inert element 34 could be made from a material which would wear preferentially, allowing replacement during maintenance, avoiding wear of necessary removal of blades.

By creating the insert elements 34 as bands of material having spaced edges 37, 38 it will be understood that these edges 37, 38 may be arranged to have radii with a common centre 39. Such configuration of the insert elements 34 will allow ready sliding in the direction of arrowheads 36 between the platform sections 35 for appropriate location. It will be noted that typically the platform sections 35 and the insert elements 34 will have a notch or other register feature 129 to ensure appropriate positioning in use.

As indicated above the shape of the insert element 34 will be such that it can slide in the gap or slot between the platform sections 35. Such capability will allow replacement of the insert element 34 when worn or damaged or to allow access for repair to the blisk blade arrangement 130 itself in terms of replacing blades.

In normal operation it will be advantageous to effectively lock the insert elements 34 in position. This may be achieved through an appropriatelock plate 50. The lock plate 50 may be secured to one side of the insert element 34 whilst the other side is simply presented in the slot and groove arrangement as described above. Alternatively, lock plates may be provided both fore and aft of the insert element 34 in use. The lock plates in such circumstances will create an appropriate flow surface about the blade arrangement in use.

It will be understood that the insert elements 34 and therefore the platform sections 35 will be displaced by a distance 40 (FIG. 2) above the periphery of the disc 31. It will be understood that this height or displacement is important with regard to providing the positional control of the blades 32 and therefore the functionality of the arrangement 130 in use. If the displacement 40 is too low then it may be difficult to achieve sufficient vibrational damping as the relative movement for different vibrational modes will be small. If the displacement 40 is too great then there will be an excessive parasitic weight upon the disc 31 which may erode any weight benefits with regard to providing a blisk format. It will be understood that the further the insert element 34 and platform sections 35 are from the periphery of the disc 31 the greater the circumference to be subtended and therefore the greater amount of material required.

As indicated above further features of aspects of the present invention relate to presenting a heat shield to protect the junction 33 and the rotor 31 as well as to improve aerodynamic profiles. With regard to a heat shield in order to preventingress of hot gases it will be understood that provision of the insert element 34 will restrict access by hot gases and therefore as indicated provide a heat protection arrangement to the rotor 31 in the form of a disc as well as a junction 33 in use.

With respect to aerodynamic profiling it will be understood that provision of the inserts 34 in the gap between the platform sections 35 increases the continuity of the surface created and therefore the potential for better aerodynamic profiling.

Figure 4:
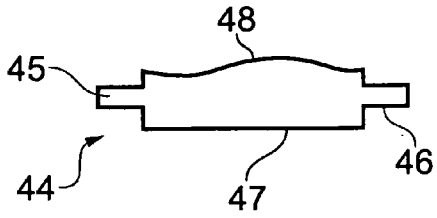
FIG. 4 is a schematic side view of an insert element in accordance with aspects of the present invention.

FIG. 4 provides a schematic illustration of an insert element 44 in accordance with aspects of the present invention. The insert element 44 as illustrated incorporates ribs or rims 45, 46 which in use as described above will generally be accommodated in reciprocal slots in the platform sections. The ribs or ridges 45, 46 will slide along the slots in use for location. It will be noted that one side, typically the bottom side 47 is relatively flat whilst an upper side 48 is curved or otherwise profiled to achieve a desired aerodynamic profile between the platform sections in an arrangement in accordance with aspects of the present invention. By appropriate sizing of the ridges or rims 45, 46 it will be understood that correct orientation of the insert 44 in use can be achieved. Nevertheless, as described above generally inserts 44 in accordance with aspects of the present invention will typically be curved bands of material and therefore correct orientation may be achieved through that configuration as well as through the elements 129.

Aspects of the present invention particularly relate to issues concerning vibrational damping. Prior approaches through use of tip dampers may not be easily incorporated with regard to blade arrangements which have a blisk formation. Such difficulties may relate to utilisation of friction welding and other techniques in order to assemble the blades to the rotor. In such circumstances there is a limit to the amount of interaction between the blades due to geometrical constraints. By utilisation of insert elements in accordance with aspects of the present invention improvements in the level of interaction can be provided through the insert elements to create damping through friction contact.

Issues with regard to heating are addressed by aspects of the present invention allowing the possibility of utilising materials which have a lower temperature capability in terms of the disc providing the rotor in comparison with prior arrangements. As indicated above typically previously the rotors were formed from similar materials to that which the blades are formed. Clearly, the blades will be subject to the temperature cycling necessary for engine operation and in such circumstances the materials from which the blades are formed can be relatively expensive. Allowing a capability for utilisation of different, and possibly cheaper, materials due to the heat shielding and protection effects of providing platform sections and insert elements in accordance with aspects of the present invention may improve the acceptability of blisk type blade arrangements.

It will be understood that air flows about blades in blade arrangements are important with regard to achieving overall operational efficiency. By utilisation of insert elements which can be profiled upon an upper surface it will be understood that an enhanced aerodynamic profile and therefore performance for a blade arrangement particularly when utilised as a turbine may be achieved.

It will be understood that the insert elements in accordance with aspects of the present invention are preferably removable. In such circumstances the insert elements particularly when primarily utilised as vibration dampers may be replaced due to wear or when repair of the blade arrangement is required. It will be understood it is friction interaction between the insert elements and parts of the platform sections which creates the vibrational damping in accordance with aspects of the present invention. Typically there may be preferential wear on the insert elements as these will be more readily replaced than the blade platform sections in use.

Generally, the insert elements in accordance with aspects of the present invention will be made from different materials from those utilised with regard to forming the blades, platform sections and discs to provide rotors upon which the blades are secured. These materials may have a lower density or otherwise optimised to balance friction, parasitic weight as well as costs and formation characteristics.

Generally, the insert elements as indicated may be slid in the gap between the platform sections. Alternatively, the insert elements may be secured from beneath or above the platform sections as required. In such circumstances location may be achieved through an appropriate locking plate or other process such that the insert element remains in place to provide the additional control desirable in accordance with aspects of the present invention.

Modifications and alterations to aspects of the present invention will be appreciated by a person skilled in the technology. Thus for example, although illustrated above as single integral elements which extend completely along the gap between opposed platform sections in a blade pair it will also be understood that combinations of two or more insert elements may be located together in alignment along the gap between the platform sections. In such circumstances insert elements having different characteristics, shaping and responsiveness may be provided. For example, the insert element may comprise three elements a front and a rear element sandwiching a central element which may extend more widely or have greater adaptability to change operationally in order to alter the vibrational damping characteristics or provide a different aerodynamic profiling between the platform sections.

The invention claimed is:

1. A blisk blade arrangement for a gas turbine, the arrangement comprising:

a rotor;

a plurality of blades that are integrally formed on the rotor;

a junction between each blade and the rotor;

at least two platform sections displaced from the junction; and an insert element extending in frictional engagement between opposing ends of the least two platform sections configured to dampen vibration between the opposing ends of the least two platform sections.

2. The blisk blade arrangement of claim 1, wherein the insert element is configured to provide a protective barrier to the junction and/or rotor.

3. The blisk blade arrangement of claim 2, wherein the protective barrier inhibits ingress of hot gas in use to the junction and/or the rotor.

4. The blisk blade arrangement of claim 1, wherein the insert element defines an aerodynamic profile for the arrangement about the rotor.

5. The blisk blade arrangement of claim 1, wherein adjacent blades form a blade pair; and the insert element interlocks with an edge of each platform in the blade pair.

6. The blisk blade arrangement of claim 5, wherein the edge incorporates a slot or ridge to engage a reciprocal part of the insert element.

7. The blisk blade arrangement of claim 1, wherein the blisk blade arrangement incorporates a lock plate to secure the insert element.

8. The blisk blade arrangement of claim 7, wherein the lock plate acts on one side of a blade pair in use.

9. The blisk blade arrangement of claim 1, wherein the at least two platform sections and the insert element are displaced from the rotor in order to provide a desired level of positional control.

10. The blisk blade arrangement of claim 1, wherein the insert element is secured from above or below adjacent platform sections in a blade pair.

11. The blisk blade arrangement of claim 1, wherein the insert element is presented for slide association between the at least two platform sections.

12. The blisk blade arrangement of claim 1, wherein the insert element comprises a band of material having respective spaced edges for association with the at least two platform sections.

13. The blisk blade arrangement of claim 12, wherein the spaced edges have radii about a common centre.

14. The blisk blade arrangement of claim 1, wherein the insert element has a surface profile.

15. A blade arrangement for a gas turbine, the arrangement comprising:

a rotor;

a plurality of blades secured to the rotor, adjacent blades forming a blade pair;

a junction between each blade and the rotor;

at least two platform sections displaced from the junction; and an insert element extending in frictional engagement between opposing ends of the least two platform sections configured to dampen vibration between the opposing ends of the least two platform sections, wherein the insert element interlocks with an edge of each platform in the blade pair.

16. A blade arrangement for a gas turbine, the arrangement comprising:

a rotor;

a plurality of blades secured to the rotor, adjacent blades forming a blade pair;

a junction between each blade and the rotor;

at least two platform sections displaced from the junction; and an insert element extending in frictional engagement between opposing ends of the least two platform sections configured to dampen vibration between the opposing ends of the least two platform sections, wherein the blade arrangement incorporates a lock plate to secure the insert element.

* * * * *